United States Patent [19]

Total

[11] Patent Number: 4,648,237

[45] Date of Patent: Mar. 10, 1987

[54] STACK HANDLING METHOD AND APPARATUS

[75] Inventor: Robert V. Total, Sun Prairie, Wis.

[73] Assignee: Oscar Mayer Foods Corp., Madison, Wis.

[21] Appl. No.: 818,309

[22] Filed: Jan. 13, 1986

[51] Int. Cl.[4] ..... B65B 5/06; B65B 39/02; B65B 39/12

[52] U.S. Cl. ..... 53/473; 53/202; 53/247; 53/258; 53/260

[58] Field of Search ..... 53/475, 473, 247, 248, 53/254, 258, 260, 537, 251, 250, 202; 414/71, 416

[56] References Cited

U.S. PATENT DOCUMENTS

| | | | |
|---|---|---|---|
| 2,938,315 | 5/1960 | Voullaire | 53/475 |
| 2,956,384 | 10/1960 | Underwood | 53/537 X |
| 3,299,613 | 1/1967 | Cella | 53/247 |
| 3,766,706 | 10/1973 | Graham | 53/260 X |
| 3,778,965 | 12/1973 | O'Lenick et al. | 53/258 X |
| 3,820,302 | 6/1974 | Doran et al. | 53/247 X |
| 3,837,140 | 9/1974 | Golantsev et al. | 53/247 X |
| 4,253,293 | 3/1981 | Loewenthal | 53/247 X |
| 4,269,016 | 5/1981 | Kopp et al. | 53/202 X |
| 4,478,024 | 10/1984 | Vedvik et al. | 53/473 |

*Primary Examiner*—Horace M. Culver

*Attorney, Agent, or Firm*—Joseph T. Harcarik; Thomas R. Savoie; Daniel J. Donovan

[57] ABSTRACT

An apparatus and method are provided in order to handle a plurality of stacks, such as stacks of sliced food products including luncheon meats. Product stacks are stopped during their flow along a conveyor pathway, the stoppage being at a location for generally vertical alignment with an overhead picker head. The picker head grasps the thus positioned stacks and moves same to a location above and in general vertical alignment with a cavity of a packaging container for the stacks of sliced product, at which time the stacks are released, and the product stacks enter the cavities which are subsequently closed to provide finished packaged products.

21 Claims, 11 Drawing Figures

74
44
53
33
51
63
49
65
62
64
47
48
66
56
6
6
67
58
65
52
54
68
52
55
57
73
5
5
69
61
59
72
41
42
78
43

STACK HANDLING METHOD AND APPARATUS

BACKGROUND AND DESCRIPTION OF THE INVENTION

The present invention generally relates to handling stacks of sliced products that includes lifting the stacks and depositing them within containers having cavities that are close-fitting with respect to the stacks. The apparatus and method of the present invention are particularly suitable for thus handling stacks of sliced food products, especially sliced sausage products such as those of the so-called luncheon meat variety including salami, summer sausage, bologna, ham and the like. More particularly, the invention relates to an apparatus and method for lifting spaced stacks of products while maintaining or enhancing the neatness of the stacks and depositing such stacks into cavities, the apparatus and method allowing for a plurality of stacks of products to be lifted substantially simultaneously and substantially simultaneously deposited into a plurality of cavities that are generally parallel to the plurality of spaced stacks.

In the manufacture and packaging of food products such as sliced sausage products, the products are typically initially formed as large sticks or loaves of sausage or other product. Often, such sticks or loaves are frozen and cut into slices by a high-speed rotary slicer which discharges the slices in loosely arranged stacks of a desired weight. The slices of each stack are then arranged into neater vertical alignment, either manually or substantially automatically, for insertion into snug or close-fitting cavities of a rigid plastic tray, which is later covered and sealed to provide a finished package. An example of a substantially automatic system in this regard is that disclosed in Vedvik and Merdler U.S. Pat. No. 4,478,024.

Manual operations for neatening stacks and filling them into the close-fitting cavities is, of course, very labor intensive. Reductions in the quantity of labor needed and the tedious nature of this labor have been achieved by systems such as those disclosed by said U.S. Pat. No. 4,478,024. Even though previously developed automatic stack depositing systems have represented substantial advances in the art, certain drawbacks tend to be experienced after such automated systems have been used for long time periods. Areas where there is room for improvement include the ability to gain access to the various assemblies and component parts of the apparatus, which access is needed both for cleaning purposes and for clearing jams, which includes the ability to readily remove products, including damaged luncheon meat stacks, from all locations within the apparatus. Also, the occurrence of jamming in previous automated systems is realized more frequently than desired, and such previous automated systems tend to require physical adjustments when changing the height of the stacks of products to be handled by the system. A desirable attribute that is not present in such previously developed automated systems is the ability to easily change to a manual filling operation in the event of a major breakdown in the lifting and depositing mechanism. Additionally, such previous automated systems can include camming assemblies that incorporate ball-shaped cam followers which tend to develop flat spots after extended use; which interferes with the smooth operation of such devices.

The present invention responds to these various factors and provides an apparatus and method for transferring stacks of sliced products from a spaced supply thereof, the transferring being into respective cavities that are close-fitting with respect to the stack of sliced products. In summary, the present invention includes an apparatus and method for transferring a stack of sliced products from a loading station into a close-fitting cavity of a container, the apparatus and method permitting generally parallel orientation and flow of stacks with respect to cavities. A stack lifter assembly raises the stack which is grasped by a picker head which then transports the stack into the close-fitting cavity while maintaining or enhancing the evenness or neatness of the stack. Such an apparatus and method have been found to reduce the likelihood of jams, even after the device is in operation for extensive periods of time, to simplify cleanup and jam clearing procedures, and to permit easy changeover for handling stacks of different sizes.

It is accordingly a general of the present invention to provide an improved stack handling apparatus and method.

Another object of this invention is to provide an improved stack handling apparatus and method that is especially reliable even after having been in use for extended time periods.

Another object of the present invention is to provide an improved apparatus and method which handles an inflow of spaced product stacks in parallel relationship to the outfeed of such stacks deposited within spaced cavities of packaging containers for the product stacks.

Another object of this invention is to provide an improved apparatus and method for depositing stacks of sliced food products into packaging containers therefor in a manner that permits simplified cleaning for sanitary purposes and simplified clearing of damaged or defective product stacks.

Another object of the present invention is to provide an improved apparatus and method for substantially simultaneously depositing spaced groups of product stacks into substantially equally spaced groups of close-fitting cavities of packaging containers, such apparatus and method including means for assuring proper stack spacing and even alignment of individual slices within the stacks.

Another object of the present invention is to provide an improved apparatus and method whereby product stacks can be readily deposited into cavities of packaging containers therefor through a manual operation in the event of apparatus breakdown.

These and other objects, features and advantages of this invention will be clearly understood through a consideration of the following detailed description.

BRIEF DESCRIPTION OF THE DRAWINGS

In the course of this description, reference will be made to the attached drawings, wherein.

DESCRIPTION OF THE PARTICULAR EMBODIMENTS

Figure 1:
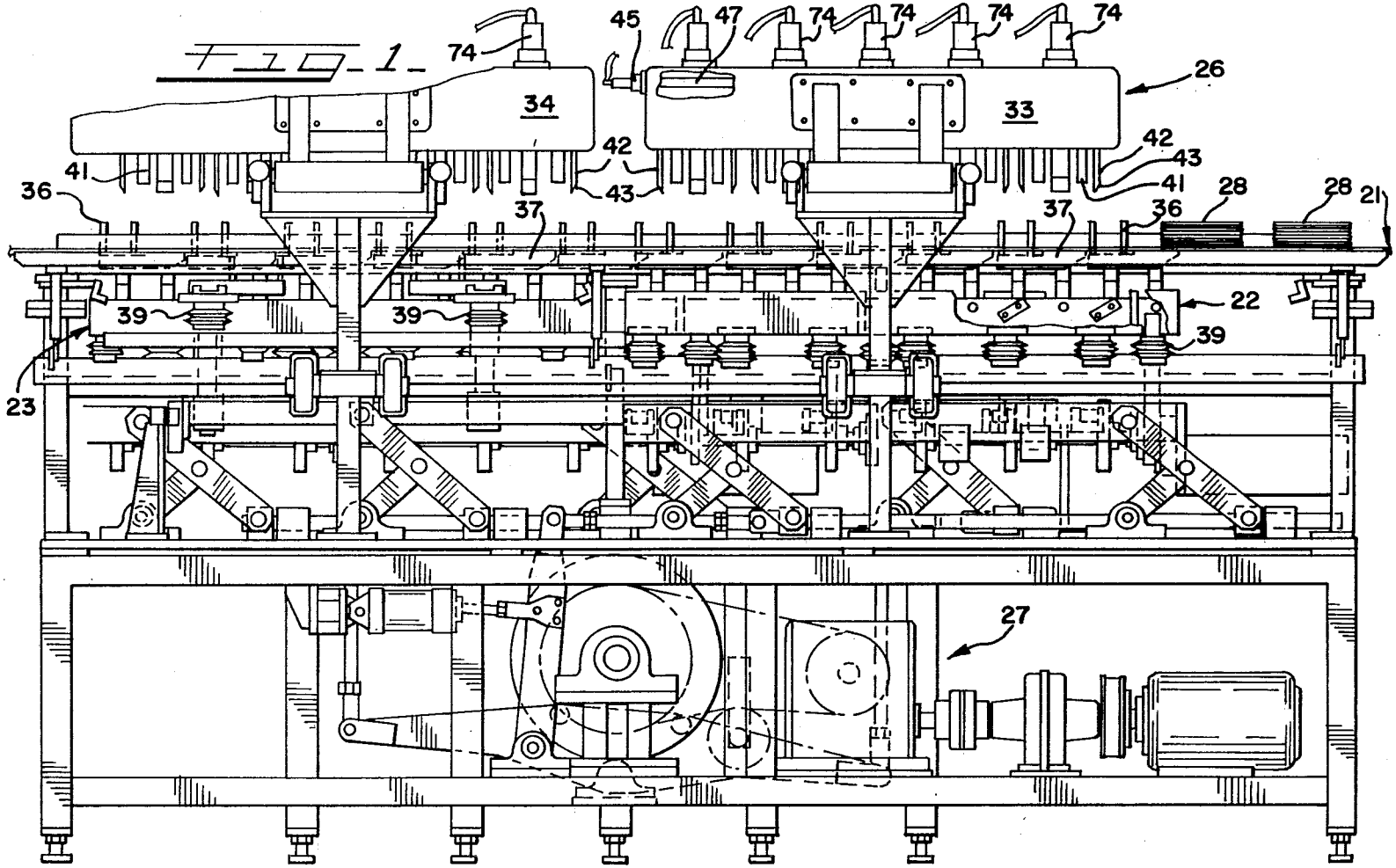
FIG. 1 is side elevational view of a preferred apparatus according to this invention.
Figure 2:
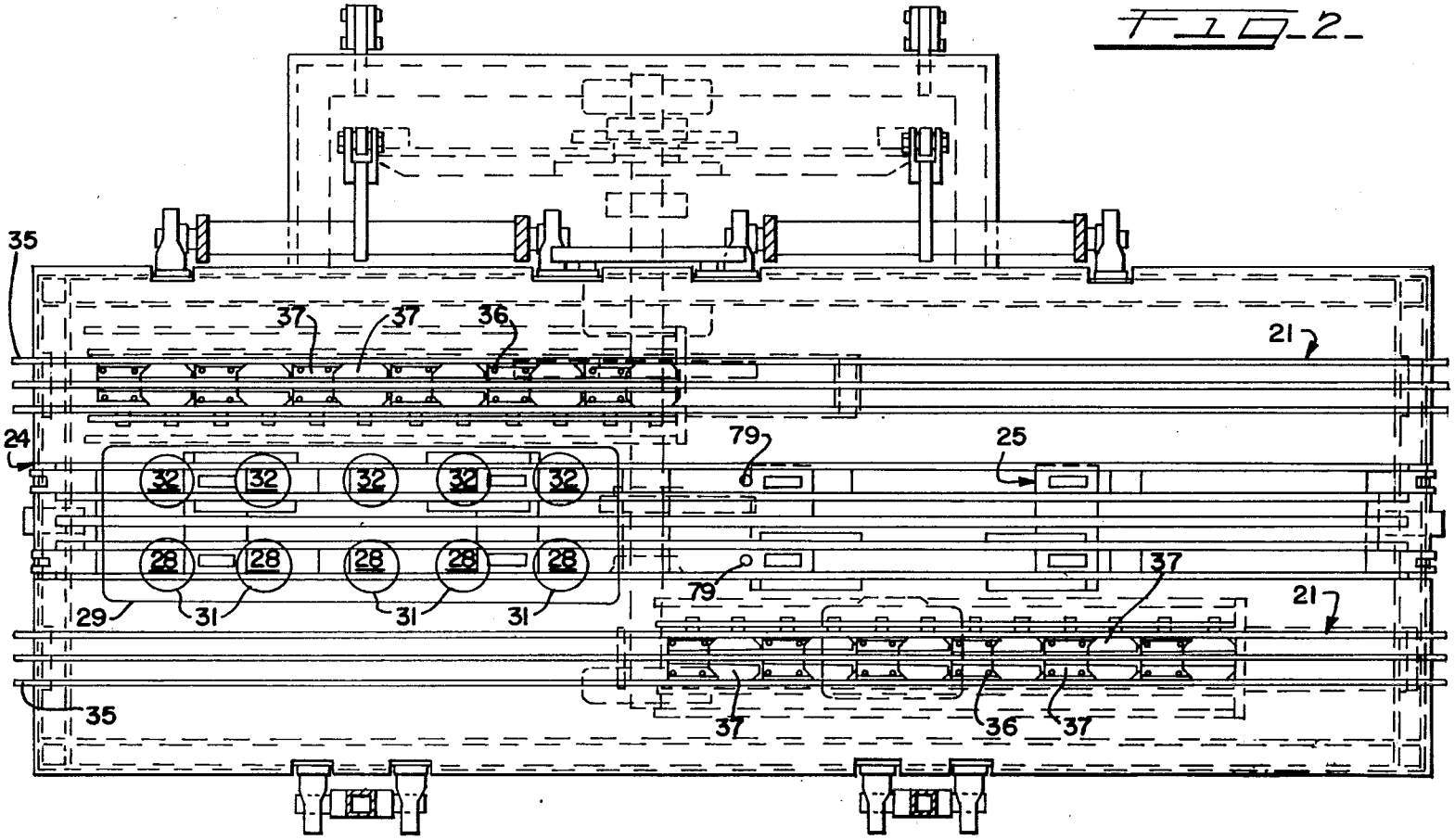
FIG. 2 is a top plan view of the apparatus illustrated in FIG. 1.
Figure 3:
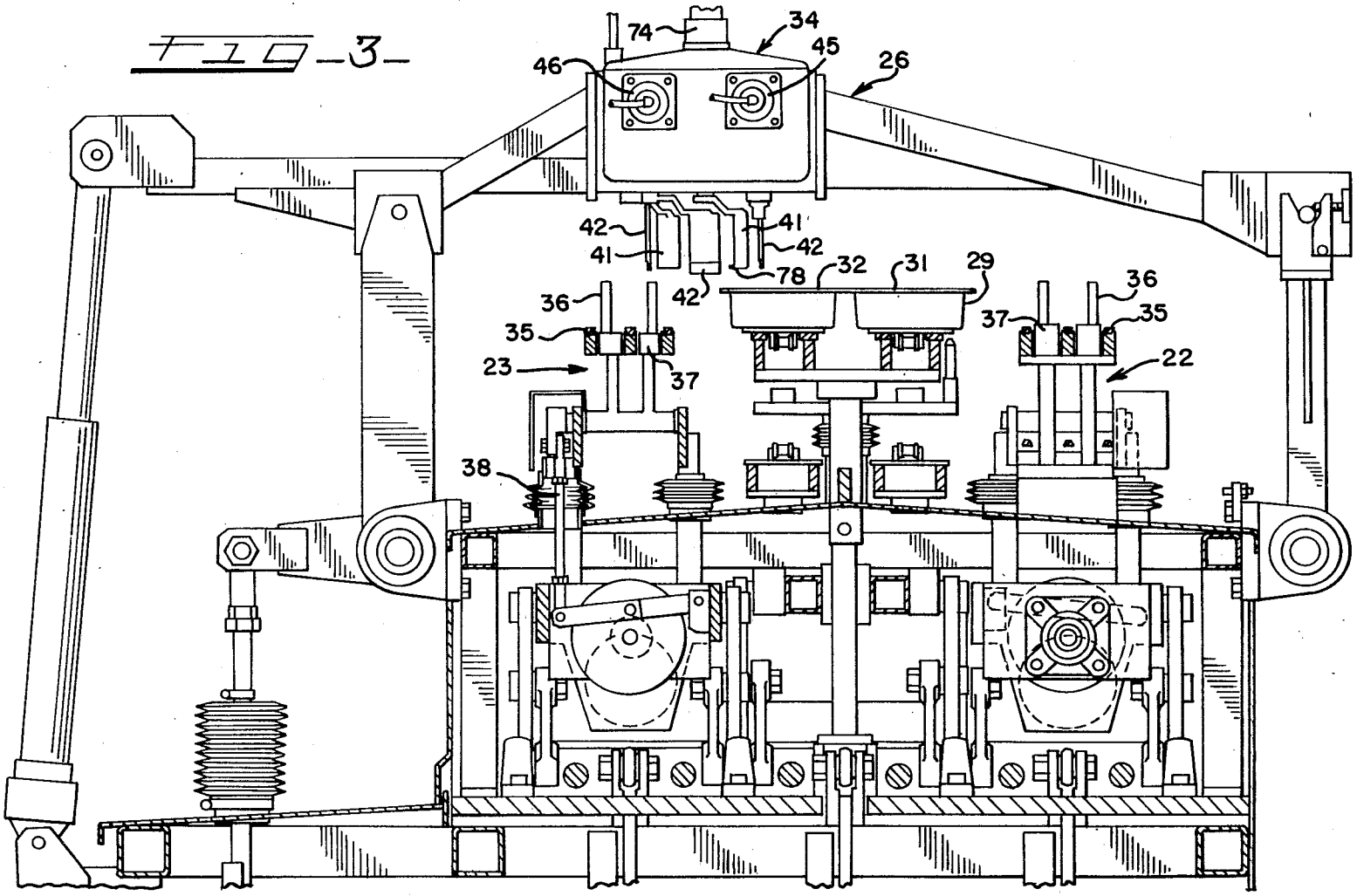
FIG. 3 is a transverse cross-sectional view through the apparatus of FIG. 1 and FIG. 2.

The apparatus, as illustrated in FIG. 1, FIG. 2, and FIG. 3 includes a pair of stack conveyors, generally designated as 21, a near side stack lifter assembly, generally designated as 22, a far side stack lifter assembly, generally designated as 23, a container conveyor, generally designated as 24, a container lifter assembly, generally designated as 25, a picker assembly, generally designated as 26, and a drive assembly, generally designated as 27. Each stack conveyor 21 is in conveying communication with an upstream unit (not shown) for slicing a stick or loaf of meat or the like and stacking the resulting slices into product stacks 28 that are fed to the stack conveyors 21 in spaced relationship with each other. Downstream of the container conveyor 24 is an assembly (not shown) for accumulating containers having cavities filled with product stacks.

The illustrated apparatus is designed to simultaneously fill five product stacks 28 into five cavities of a typically transparent container blank 29, with the near side stack lifting assembly 22 filling one row of such cavities 31 and the far side stack lifter assembly 23 filling an adjoining row of such cavities 32. It will be understood, however, that the number of cavities filled by this apparatus can be chosen as desired. Also, while providing a pair of stack conveyors 21 is especially efficient, the number of such conveyors can be chosen as desired.

It will be observed that the stack conveyors 21 and the container conveyor 24 are generally parallel to each other. The near side stack lifter assembly 22 stops the flow of product stacks 28, assists in neatening the product stacks 28 if necessary, and assures that the center-to-center spacing between adjacent product stacks 28 corresponds to the center-to-center spacing between adjacent cavities 31 of the container blanks 29. Likewise, far side stack lifter assembly 23 stops the flow of product stacks 28, assists in neatening the product stacks 28 if necessary, and assures that the center-to-center spacing between adjacent product stacks 28 corresponds to the center-to-center spacing between adjacent cavities 32 of the container blanks 29. The illustrated picker assembly 26 includes two picker heads 33 and 34. Near side picker head 33 removes stacks 28 from near side lifter assembly 22 and deposits them into near side cavities 31, while far side picker head 34 removes stacks 28 from the far side stack lifter assembly 23 and deposits them into the far row of cavities 32 of each container blank 29 when it is suitably indexed and positioned on the container conveyor 24. In this way, product stacks 28 are lifted from the stack conveyors 21 and are deposited into the cavities 31, 32 of the container blanks 29.

Each stack conveyor 21 typically includes a plurality of endless elastic conveyor bands 35, while each stack lifter assembly 22, 23 includes a plurality of upstanding pins 36 which readily pass between the conveyor bands 35. Each pin 36 is mounted onto a pin support plate 37 which is sized and shaped such that at least a portion thereof can engage a bottom portion of a product stack 28 and lift that stack 28 off of the stack conveyor 21 by passing through conveyor bands 35. After product stacks 28 are appropriately located between desired upstanding pins 36, a suitable lift mechanism including vertical movable shafts 38 within sealed casings 39, raises the pin support plates 37 and pins 36, as well as the stacks 28 located thereon to a height well above the stack conveyors 21 in order to permit unobstructed grasping of the product stacks 28 off of the pin support plates 37 by the picker heads 33, 34.

Picker heads 33, 34 include a plurality of downwardly depending fingers, preferably including claws 41 and shoes 42. Each claw 41 moves into engagement with the underside of the bottommost slice in a product stack 28 in order to thereby support a product stack 28 when support plate 37 subsequently drops and when picker head 33, 34 moves into alignment over the container blank 29 on the container conveyor 24. When each product stack 28 is aligned for insertion into a cavity 31, 32, the claws 41 move out of engagement with the lowermost slice of the product stack 28 in order to permit unobstructed downward movement of the product stack 28 into the cavity 31, 32. Each shoe 42 serves to assist in maintaining slice alignment of the product stacks 28. Furthermore, each shoe 42 has a step 43 that extends beyond the bottommost portion of each claw 41 so that the shoes 42 will assist in guiding the product stacks 28 into the cavities 31, 32.

Figure 4:
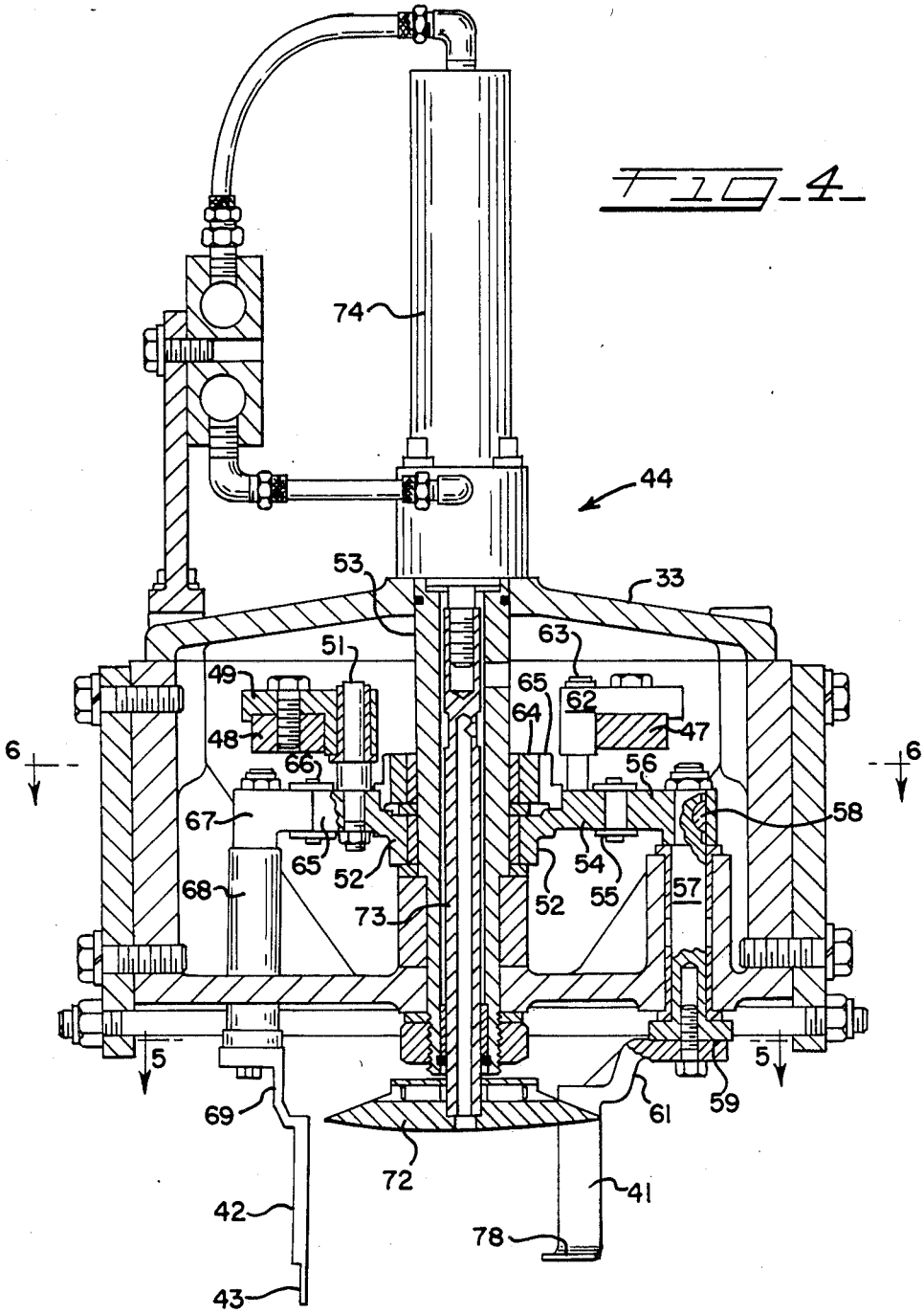
FIG. 4 is an enlarged cross-sectional view of the preferred picker head according to this invention.
Figure 5:
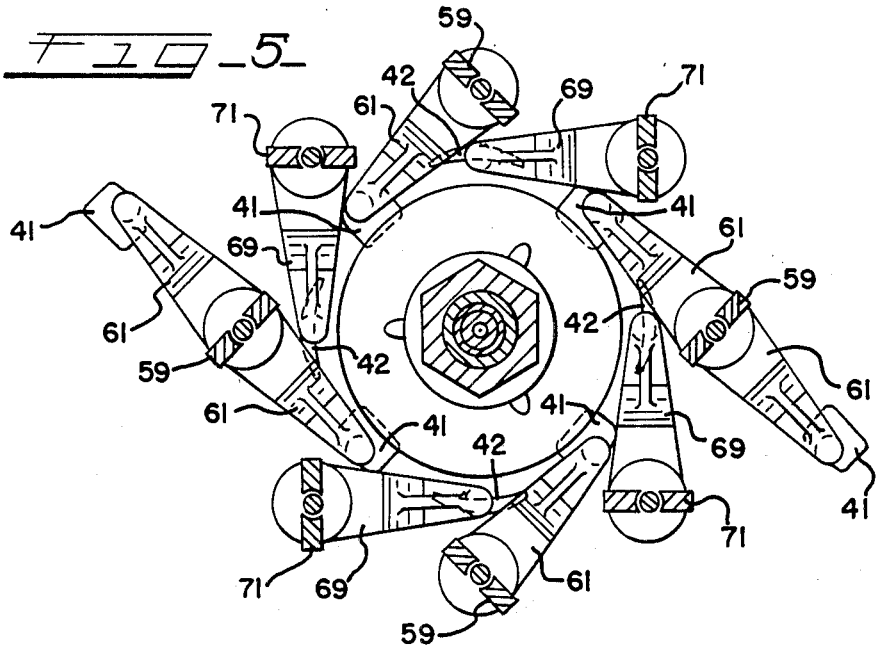
FIG. 5 is a cross-sectional view along the line 5—5 of FIG. 4.
Figure 6:
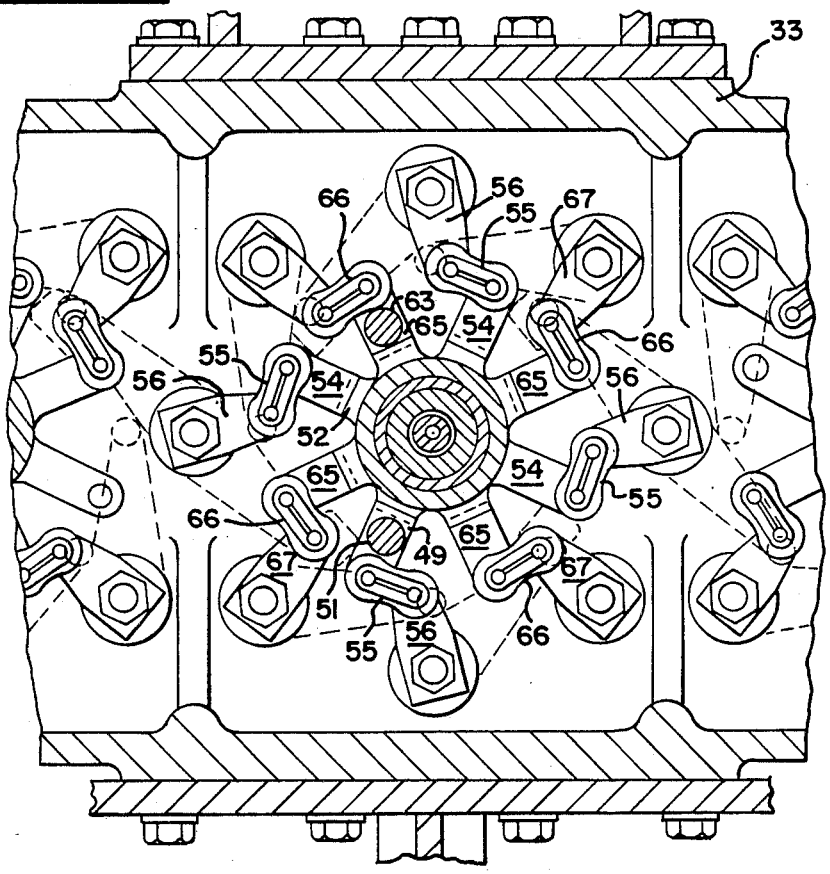
FIG. 6 is a cross-sectional view along the line 6—6 of FIG. 4.

FIG. 4, FIG. 5 and FIG. 6 illustrate a preferred mechanism for effecting movement of the claws 41 and the shoes 42 between an open orientation and a closed orientation that provides general engagement with a product stack 28. In the illustrated embodiment, claws 41 and shoes 42 are pivotally mounted alternately with each other, and they are generally equally spaced in a pattern approximating the shape of the slices being handled, typically either generally circular or generally square.

Each picker head 33, 34 includes a plurality of picker units, generally designated as 44 in FIG. 4. Each picker unit 44 is actuated by a pair of moving assemblies such as ones including the illustrated double acting cylinders 45, 46 (FIG. 3) which move elongated bars 47, 48 longitudinally back and forth within each picker head 33, 34. In the configuration that is illustrated in the drawings, the cylinder 45 and the shoe bar 47 simultaneously operate four shoes 42 of each picker unit 44, while the cylinder 46 and the claw bar 48 simultaneously operate four claws 41 of each picker unit 44.

More particularly, elongated claw bar 48, which moves into and out of the paper as illustrated in FIG. 4, will likewise move arm 49 secured thereto. A stud 51 is mounted through the arm 49 and engages a claw actuator 52 which is rotatably mounted onto a generally vertical axial shaft 53 of the picker unit 44. The claw actuator 52 includes four projecting lever arms 54 onto which are mounted rotation devices such as the illustrated roller chain connector links 55. A generally L-shaped member is pivotally mounted to each link 55. In the illustrated embodiment, this L-shaped member includes a bracket 56 secured to a generally vertical shaft 57 by a key 58. A claw 41 is rigidly secured to the bottom of the vertical shaft 57 by any suitable means such as the illustrated flat and slot assembly 59 secured together by a bolt or the like.

As illustrated, each claw 41 is generally L-shaped and includes a mounting portion 61 that is generally at a right angle to the stack engaging portion of the claw 41. By this structure, each claw 41 rotates, in response to actuation of the cylinder 46, so as to move between a closed orientation for engagement with a stack 28 and an open orientation that is out of engagement with a stack 28. Each claw 41 also includes an inwardly directed flange 78.

An independent actuation assembly is provided for simultaneously rotating all of the shoes 42 of each of the picker units 44 between an orientation for engagement with a stack 28 and an orientation out of engagement with a stack 28. The illustrated structure for effecting this rotation operation is substantially the same as that described herein for operation of the claws 41. That is, the cylinder 45 longitudinally moves the elongated shoe bar 47 to thereby move an arm 62 and a stud 63 mounted therewithin. Stud 63 is in operative engagement (not shown in FIG. 4) with a shoe actuator 64 having a plurality (four being illustrated in FIG. 6) of projecting lever arms 65. A roller chain connector link 66 or the like is attached at one its ends to each of the projecting lever arms 65, while its other end is attached to an L-shaped shaft including a bracket 67 and a vertical shaft 68. A generally right-angled mounting portion 69 of each shoe 42 is securely affixed to the bottom of the shaft 68 such as by the illustrated flat and slot assembly 71.

Each picker unit 44 also includes a pusher assembly including a pusher 72 which is provided for exerting a downward force onto the top slice of a stack 28 in order to facilitate movement of the stack 28 into one of the cavities 31, 32. The pusher assembly includes an elongated shaft 73 onto which the pusher 72 is mounted. A suitable device, such as the illustrated double acting cylinder 74 is provided for effecting longitudinal back and forth movement of the elongated shaft 73 in order to impart up and down movement to the pusher 72.

FIGS. 7, 8, 9, 10 and 11 illustrate operational features of the stack lifter assemblies 22, 23. Each assembly 22, 23 includes the upstanding pins 36 and the pin support plates 37 as previously described herein. The pin support plates 37, which are preferably provided in adjacent pairs, are swingably mounted from below and includes a lifter pad portion 75. The illustrated swingable mounting of each plate 37 includes a double bar linkage 76 for each plate 37 and includes a driving pin 77 attached to a pair of double bar linkages 76. Each driving pin 77 is rotated at appropriate times by the drive assembly 27 through suitable drive members (not shown). When each driving pin 77 is rotated in the counterclockwise direction a illustrated in FIGS. 7 through 11, each adjacent pair of pin support plates 37 swings upwardly and in a generally downstream direction, such movement being generally arcuate.

Figure 7:
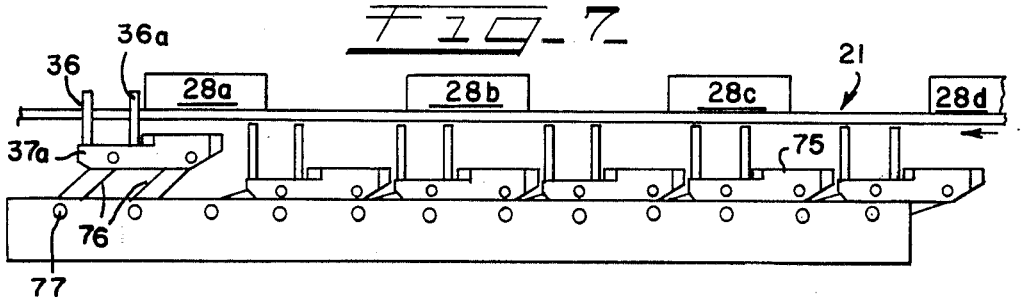
FIG. 7 is a somewhat schematic view illustrating a first stage of operation of the preferred stack lifter and spacer assembly.
Figure 8:
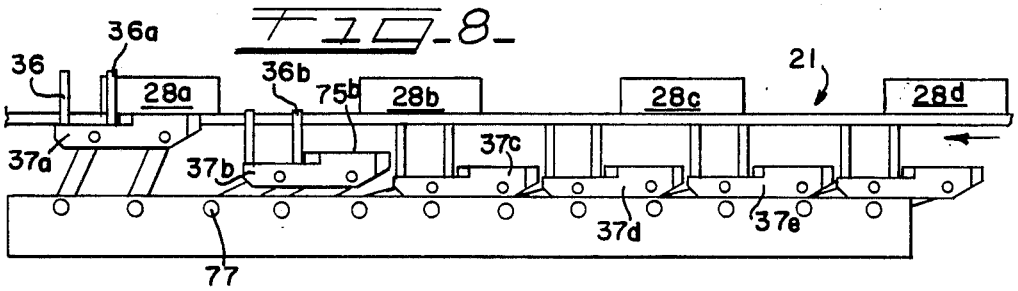
FIG. 8 is a somewhat schematic view illustrating a second stage of operation of the lifter and spacer assembly illustrated in FIG. 7.
Figure 9:
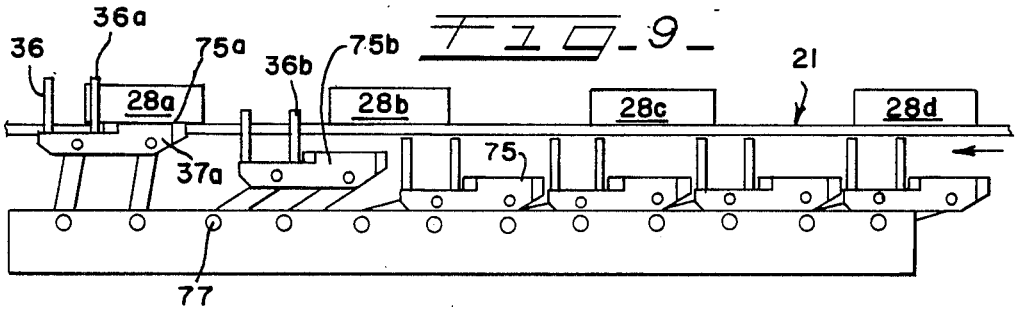
FIG. 9 is a somewhat schematic view illustrating a third stage of operation of the lifter and spacer assembly illustrated in FIG. 7.
Figure 10:
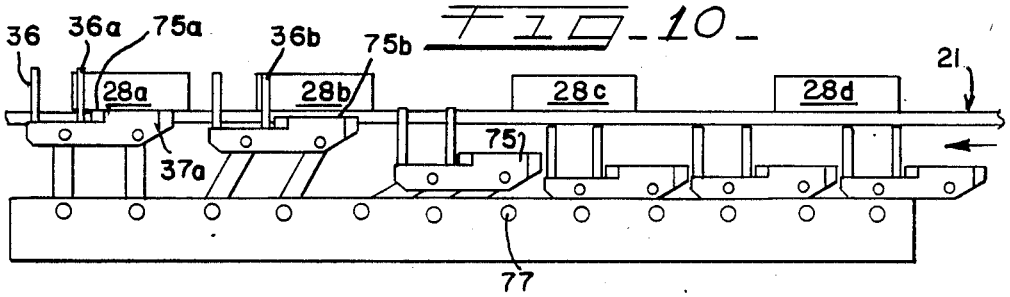
FIG. 10 is a somewhat schematic view illustrating a fourth stage of operation of the lifter and spacer assembly illustrated in FIG. 7.

A plurality of product stacks 28*a*, 28*b* 28*c* 28*d* and 28*e* are shown being moved along by the stack conveyor 21. The initial spacing between each said stacks approximates, but need not be identical to, the final spacing needed for proper alignment with each picker unit 44 of each picker head 33. For example, in the drawings, the spacing between stacks that is shown in FIG. 7 is greater than the spacing between stacks that is shown in FIG. 11, which latter spacing provides the aforesaid alignment between the stacks and the picker units 44 such that the periphery that is generally defined by the claws 41 and shoes 42 thereof, when disposed above each product stack, will be outside of the periphery of the product stack.

The movement sequence of the pin support plate 37 and upstanding pins, some being stop pins and others being backup pins, with respect to the flowing products begins with the swinging, generally upward arcuate movement of the first or most downstream of the pin support plates, designated 37. In the illustration, the product stacks are generally circular in horizontal cross-section, and product stack 28*a* engages and is stopped by adjacent stop pins 36*a* mounted on adjacent plates 37*a*. Continued movement of each first pin support plate 37*a* raises the stack 28*a* above the stack conveyor 21 until the stack 28*a* rests on the lifter pad portion 75*a* of each adjacent support plate 37*a*. Details of movements in this regard are illustrated in FIGS. 7, 8, 9 and 10.

Figure 11:
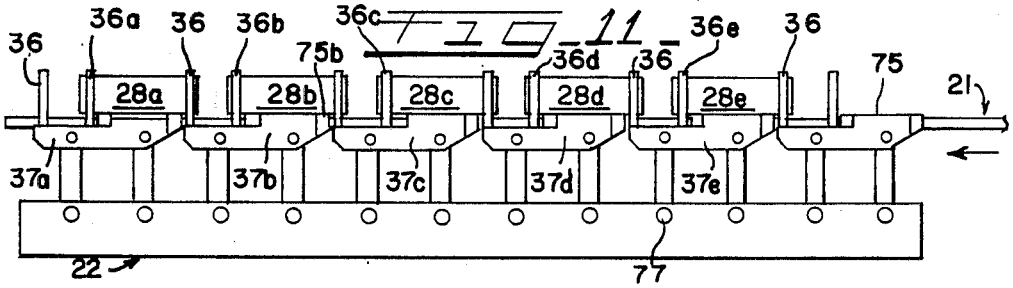
FIG. 11 is a somewhat schematic view illustrating a fifth stage of operation of the lifter and spacer assembly illustrated in FIG. 7.

Substantially identical relative movements of the second pair of pin support plates 37*b* with respect to the second product stack 28*b* and second pair of stop pins 36*b* are illustrated in FIGS. 8, 9, 10 and 11. FIG. 11 further illustrates how the pair of pins 36 which is intermediate to the stop pins 36*a* and 36*b* performs the function of a backup pin in order to substantially completely "cage" the product stack 28*a*.

The next adjacent pair of pin support plates 37*c* which is upstream of pin support plates 37*b* then proceeds in substantially the same manner with respect to product stack 28*c*. This sequence of movement of pin support plates with respect to product stacks continues sequentially in the upstream direction until each of the product stacks 28*a*, 28*b*, 28*c*, 28*d* and 28*e* rest on the respective pin support plates 37*a*, 37*b*, 37*c*, 37*d* and 37*e*, preferably to the extent illustrated in FIG. 11 wherein each of the product stacks is lifted off of the stack conveyor 21 which may thereby continue to move without disruption of or damage to the product stacks. When the orientation illustrated in FIG. 11 is reached, the entire lifter assembly 22 is, at the appropriate time, raised by the operation of the vertically movable shafts 38 (FIG. 3) to a higher location that provides substantial spacing between the conveyor 21 and the bottom surface of the product stacks.

With particular reference to operation of the apparatus and to the method as it is practiced according to this invention, a spaced flow of product stacks 28 is transported onto the stack conveyor assemblies 21, the bands 35 preferably moving at a substantially constant speed. As this flow of spaced product stacks continues, the product stacks are stopped and caged according to the sequence of FIGS. 7 through 11 until each product stack is located as illustrated in FIG. 11. For purposes of discussion, the illustrated apparatus will be referred to, such including two stack conveyors 21 with the container conveyor 24 being spaced therebetween in substantially parallel fashion. The near side stack lifter assembly 22 is positioned under the near side stack conveyor, and the far side stack lifter assembly 23 is positioned under the far side stack conveyor. The near side stack lifter assembly 22 and the far side stack lifter assembly 23 are staggered longitudinally as illustrated.

The far side stack lifter assembly 23 will reach the filled condition illustrated in FIG. 11 prior to the time that such condition is reached at the near side stack lifter assembly 22.

Next, the picker head 33 moves toward the near side of the apparatus, which is out of the paper in FIG. 1 and to the right in FIG. 3 (picker head 33 is not illustrated in FIG. 3) until the peripheries defined by the claws 41 and the shoes 42 of the picker head 33 are positioned above the respective peripheries of the product stacks 28. At this stage, each of the claws 41 and shoes 42 have been rotated to their respective open positions, and the respective peripheries that are generally defined by the thus open claws 41 and shoes 42 are slightly larger than the respective peripheries of the product stacks 28 in order to thereby facilitate passage of each stack into each periphery of the open claws 41 and shoes 42 when the near side stack lifter assembly 22 is raised to a height at which the bottommost slice of the product stack 28 is slightly above the inside surface of the generally inwardly directed flanges 78 of the claws 41. This upward movement of the near side stack lifter assembly 22 is timed to occur after the picker head 33 and this lifter assembly 22 are in general vertical alignment with each other as previously discussed.

At this time, the cylinder 45 is actuated, and all of the claws 41 and shoes 42 of the picker head 33 rotate to their closed positions, whereby the four flanges 78 of the claws 41 move under the lowermost slice of each product stack 28 resting on support plates 37. Likewise, the cylinder 46 is actuated such that the shoes 42 rotate into closer proximity to, and in many cases engagement with, the vertical outside surface of each product stack 28. Near side lifter assembly 22 then drops, and the picker head 33 moves toward the longitudinal center of the apparatus until the product stacks 28 are positioned generally above the near row of cavities 31 of a container blank 29 that is positioned at a predetermined longitudinal location on the container conveyor 24. Upstanding movable pins 79 (FIG. 2) or other suitable devices may be provided for this purpose of properly positioning the blanks 29.

Once the product stacks 28 within the picker head 33 are thus aligned above the near cavities 31, the container lifter assembly 25 is actuated in order to raise the container blank 29 to a height at which the bottommost slices are slightly above the upper surface of the container blank 29. At this time, because the shoes 42 project downwardly by a distance that is somewhat greater than the flanges 78 of the claws 41, the steps 43 of the shoes 42 are able to enter the cavities 31 to thereby provide a guideway for entry of the product stacks 28 into the cavities 31. When this orientation is achieved, the cylinder 46 is again activated in order to thereby swing the claws 41 into their respective open positions, at which time the flanges 78 cease to be in engagement with the bottom of the product stacks 28, and the product stacks 28 are free to enter the respective cavities 31.

At times, the operation of gravity alone on the product stacks 28 will not be adequate to cause the product stacks to immediately fall into the cavities 31. Accordingly, each cylinder 74 is activated in order to move each pusher 72 downwardly to thereby engage the respective top surfaces of the product stacks 28 in order to thereby rapidly move the product stacks into the cavities 31, after which the cylinder 74 is again activated to thereby raise the pusher 72. At this stage, the near row of cavities 31 is full, and the container lifter assembly 25 drops down to its lowered position, and the container conveyor 24 moves the half-filled container blank 29 to a predetermined location that is adjacent to the far side stack lifter assembly 23.

The far side stack lifter assembly 23 operating at the same time as the near side stack lifter assembly 22 raises the properly positioned product stacks 28 in the same manner that such function is accomplished by the near side stack lifter assembly 22 and after the picker head 34 has moved so that the respective peripheries defined by its claws 41 and shoes 42 are in general vertical alignment with the respective peripheries of the product stacks 28 on the far side stack lifter assembly 23. Thereafter, the cylinders 45 and 46 of the picker head 34 are actuated so that the claws 41 and the shoes 42 are closed generally onto the respective stacks 28 supported by the far side lifter assembly 23. The far side stack lifter assembly 23 then drops to a lowered position, and the picker head 34 moves in a direction that is out of the paper in FIG. 1 and to the right in FIG. 3 until the product stacks 28 supported thereby are in general vertical alignment with the far row of cavities 32 of the half-filled container blank 29, after which the container lifter assembly 25 is raised until the shoes 42 enter the cavities 32, at which time the claws 41 are rotated to their open position and the pusher 72 assists entry of the product stacks 28 into the far row of cavities 32 to thereby complete the filling of container blank 29. Filled container blank 29 is then ready for further processing, including closure and sealing of the cavities 31 and 32 in order to provide a finished packaged product.

It will be understood that the embodiments of the present invention which have been described are illustrative of some of the applications of the principles of the present invention. Numerous modifications may be made by those skilled in the art without departing from the true spirit and scope of the invention.

I claim:

1. An apparatus for transferring a stack of sliced food products from a loading station into a close-fitting cavity of a container, the apparatus comprising:

a stack conveyor assembly for transporting a stack of products;

a stack lifter assembly positioned generally below said stack transporting conveyor assembly, said stack lifter assembly including lifter means for raising said stack of products above said conveyor assembly;

a picker head assembly having picker head means for grasping said stack of products when same is on said lifter means;

a conveyor assembly for transporting a container having a cavity that is close-fitting with respect to said stack of products, said container conveyor assembly being associated with means for positioning the container, and said container conveyor assembly being generally parallel to said stack conveyor assembly; and said picker head assembly includes transport means for moving said picker head and stack of products grasped thereby from said stack lifter means and into said close-fitting cavity of the container at said container positioning means.

2. The apparatus according to claim 1, wherein a pair of stack conveyor assemblies are provided, and said container conveyor assembly is located therebetween.

3. The apparatus according to claim 1, wherein said stack conveyor assembly transports a plurality of said product stacks in spaced relationship to each other, and wherein said stack lifter assembly adjusts said spaced relationship according to a predetermined pattern that corresponds to spacing between a plurality of said picker head means of the picker head assembly.

4. The apparatus according to claim 1, wherein said stack lifter assembly includes a plurality of swingably movable support plates that pass through said stack conveyor assembly, each support plate having an upstanding pin for engaging said product stack, and each said support plate includes a pad portion for supporting said product stack, said pad portion maintaining a substantially horizontal orientation during swinging movement of said support plate.

5. The apparatus according to claim 1, wherein said picker head means includes a plurality of downwardly depending fingers that are pivotally mounted about a generally vertical axis for pivoting movement between a closed orientation immediately adjacent to said product stack and an open orientation that generally defines a periphery which is larger than the periphery of the product stack.

6. The apparatus according to claim 5, wherein said plurality of fingers includes alternating claws and shoes, each said claw having an inwardly directed generally horizontal bottom flange, and each said shoe has a generally vertical bottom portion that extends below each said claw bottom flange.

7. The apparatus according to claim 5, wherein each of said fingers is pivotally mounted to the remainder of said picker head means through a generally horizontal mounting portion of the upper end of each said finger, and wherein each said generally horizontal mounting portion is rotated about the generally vertical axis in response to movement of lever means of said picker head means.

8. The apparatus according to claim 6, wherein said picker head means includes separate actuation assemblies, one said actuation assembly simultaneously effecting said pivoting movement of each of said claws, and the other said actuating assembly simultaneously effecting said pivoting movement of each of said shoes.

9. The apparatus according to claim 1, wherein said stack lifter assembly includes a plurality of swingably mounted support plates longitudinally positioned along said stack conveyor assembly, and wherein said support plates swingably move above said stack conveyor assembly in a sequential manner, beginning with the downstreammost of said support plates.

10. The apparatus according to claim 1, wherein said stack lifter assembly includes a plurality of upstanding pins which, when the stack lifter assembly is in a raised orientation, form a cage around said product stack, said cage including at least one of said pins for engagement with a front portion of the product stack and at least another of said pins for engagement with a rear portion of the product stack.

11. The apparatus according to claim 1, wherein said container conveyor assembly includes container lift means for raising the container off of conveyor belts of the container conveyor assembly and into generally adjacent vertical alignment with said picker head means.

12. A method for transferring a stack of sliced food products from a loading station into a close-fitting cavity of a container, the method comprising:

transporting a stack of products by a stack conveyor assembly to a location generally above a stack lifter assembly;

lifting the stack of products with the lifter assembly and raising said stack above the conveyor assembly;

grasping said stack of products with a picker head when said stack is thus raised;

selecting a container having a cavity that is close-fitting with respect to said stack of products and transporting said selected container by a container conveyor assembly to a selected position, including locating the container conveyor assembly generally parallel to the stack conveyor assembly; and transporting said picker head while same continues to grasp said stack of products, said transporting step including removing the product stack from said lifter and inserting same into said close-fitting cavity of the container at said selected position.

13. The method according to claim 12, wherein said product stack transporting step includes alternatively longitudinally moving groups of spaced product stacks on one side of the container conveyor assembly and then on an opposite side of the container conveyor assembly.

14. The method according to claim 12, wherein said product stack lifting step includes adjusting spacing between a plurality of said product stacks according to a predetermined pattern that corresponds to spacing between a plurality of picker head units during said grasping step.

15. The method according to claim 12, wherein said product stack lifting step includes swinging a plurality of support plates from a location generally below the stack conveyor assembly to a location generally above the stack conveyor assembly, said swinging including maintaining a horizontal orientation of said support plates.

16. The method according to claim 15, wherein said swinging process includes swingably moving the support plates above the conveyor assembly in a sequential manner, beginning with the downstreammost of the support plates.

17. The method according to claim 12, wherein said product stack grasping step includes pivoting a plurality of generally downwardly depending fingers about a generally vertical axis between a closed orientation immediately adjacent to the product stack and an open orientation that generally defines a periphery which is larger than the periphery of the product stack.

18. The method according to claim 17, wherein said pivoting process includes simultaneously effecting said pivoting movement of alternating ones of said fingers and simultaneously effecting said pivoting movement of the fingers between said alternating fingers.

19. The method according to claim 12, wherein said step of selecting the container includes raising the container conveyor assembly and said container.

20. The method according to claim 12, wherein said product stack is a plurality of slices of luncheon meat.

21. The method according to claim 12, further including moving the picker head in a generally horizontal manner between a location substantially directly above the stack lifter assembly and a location substantially directly above the cavity of the container on the container conveyor assembly.

* * * * *